US006114694A

United States Patent [19]

Ito

[11] Patent Number: 6,114,694

[45] Date of Patent: Sep. 5, 2000

[54] DEVICE HAVING FIELD EMISSION TYPE COLD CATHODE AND VACUUM TANK EXHAUSTING METHOD AND SYSTEM IN THE SAME

[75] Inventor: Fuminori Ito, Tokyo, Japan

[73] Assignee: NEC Corporation, Tokyo, Japan

[21] Appl. No.: 09/045,796

[22] Filed: Mar. 23, 1998

[30] Foreign Application Priority Data

Mar. 25, 1997 [JP] Japan ..... 9-071673

[51] Int. Cl.[7] ..... H01J 9/38

[52] U.S. Cl. ..... 250/289; 445/38; 445/42

[58] Field of Search ..... 250/289; 445/38, 445/42

[56] References Cited

U.S. PATENT DOCUMENTS 3,658,401 4/1972 Files ..... 445/42

FOREIGN PATENT DOCUMENTS 63-69125 3/1988 Japan .
7-18341 3/1995 Japan .
9-35670 2/1997 Japan .

OTHER PUBLICATIONS

F. Sciuccati et al, "A study of the residual gas atmosphere during operational life of 20" 110° CCRTs as a function of bake–out temperature during processing", Vacuum, vol. 38, No. 8–10, pp. 847–851, 1988.

C. A. Spindt et al, "Physical properties of thin–film filed emission cathodes with molybdenum cones", Journal of Applied Physics, vol. 47, No. 12, Dec. 1976, pp. 5248–5263.

*Primary Examiner*—Jack Berman

*Attorney, Agent, or Firm*—Sughrue, Mion, Zinn, Macpeak & Seas, PLLC

[57] ABSTRACT

The present invention discloses a field emission type cold cathode incorporated device, which comprises a field emission type cold cathode having a number of electron emitting sections, said sections having sharp projections, and a vacuum tank for placing the field emission type cold cathode in a vacuum environment. In this device, a partial pressure of particular noble gas in residual gas contained in the vacuum tank is set equal to or lower than C/I (C is a constant and I is a maximum emission current value per one of the number of electron emitting sections during driving of the field emission type cold cathode). Also, in order to set a partial pressure of the particular noble gas in the residual gas contained in the vacuum tank equal to C/I (C: constant) or lower, a partial pressure of the particular residual gas in the vacuum tank is monitored by a mass analyzer during vacuum tank exhaustion.

10 Claims, 10 Drawing Sheets

DEVICE HAVING FIELD EMISSION TYPE COLD CATHODE AND VACUUM TANK EXHAUSTING METHOD AND SYSTEM IN THE SAME

BACKGROUND OF THE INVENTION

1. Field of the Invention

The present invention relates to an exhausting method of a vacuum tank in a device having a field emission type cold cathode, which can be used as an electron beam source for an electron microscope, an electron beam exposing device, a cathode ray tube (CRT), a flat panel display and other various electron beam devices.

2. Description of the Related Art

The field emission type cold cathode includes an emitter formed to be a cone-shaped sharp electron emission section and a gate layer having a sub-micron level radiation hole formed to be insulated against the emitter for exposing the same, each of which is disposed in a vacuum. This cold cathode serves as an electron source for emitting electrons from the tip part of the emitter into a vacuum when a positive voltage is applied to the gate layer against the emitter. For a manufacturing technique of such a field emission type cold cathode, reference may be made to, for example, the manufacturing method of a field emission type cold cathode using high melting point metal (molybdenum) for an emitter material presented on page 5248 of "Journal of Applied Physics. Vol. 47 (1976)".

A device which includes the field emission type cold cathode will be described below with reference to FIG. 1.

Emitters 1 are disposed on a conductive substrate 2 (alternatively, a conductive film formed on an insulated substrate). Gate layers 3 are disposed on an insulated layer 4 so as to surround the emitters 1, and a positive gate voltage 7 is applied against each emitter 1. An anode electrode 5 is positioned above the emitters 1, and a positive anode voltage 6 is applied against each emitter 1. Electrons are emitted from the tip part of the emitter 1 where an electronic field concentrates, and the emitted electrons flow into the anode electrode 5 having a positive voltage. A vacuum tank 8 is provided to isolate the emitters 1 and the anode electrode 5 from an atmosphere. The vacuum tank 8 is always exhausted by a vacuum pump 11 having a high exhaust speed, and preferably a very high vacuum state should be maintained. However, for a device which is not so large or heavy, typically, the vacuum tank 8 is completely detached from the exhaust system after vacuum exhaustion and then used under an isolated vacuum environment.

For example, for incorporating the field emission type cold cathode as an electron gun in a CRT, the exhausting process of the CRT goes as follows. Referring to FIG. 2, first, the neck section 12 of a CRT 14 and an exhaust line 15 are connected to each other by a connecting section 13, and the CRT 14 is exhausted by a vacuum pump 11 such as an oil diffusion pump or the like provided in the exhaust line. During exhaustion, the temperature of the CRT 14 must be maintained at 300° C. to 400° C. After exhaustion, the connecting section 13 between the neck section 12 of the CRT 14 and the exhaust line 15 is cut off and then a tip of the neck section 12 is sealed (tipped-off). Then, a getter 10 disposed in the CRT 14 is evaporated by high frequency induction heating performed from the outside and then stuck to the inner wall of the CRT 14. Since a getter 10 is chemically active, the getter 10 stuck to the inner wall of the CRT 14 absorbs residual gas inside the CRT 14 so as to further increase a vacuum level therein. Regarding the vacuum level inside the CRT 14 obtained by such an exhausting process, "Vacuum. Vol. 38" has reported on page 848 that a vacuum level is around $10^{-7}$ Torr and the major portion of residual gas is argon.

As described above, when the field emission type cold cathode is used in an independent vacuum tank such as a CRT, a high vacuum level of around $10^{-7}$ Torr is maintained. However, the effect of residual gas to an electron emission characteristic cannot be ignored in such a vacuum environment. In other words, as shown in FIG. 3, the residual gas has caused the deterioration of an electron emission characteristic after the passage of time, that is, image instability.

It has been known that the electron emission characteristic of the field emission type cold cathode is sensitive to the kind of residual gas in a vacuum for driving the same and the partial pressure of the residual gas. Particularly, the positive ions of the residual gas ionized by the emitted electrons are implanted to the emitters having negative potentials. Ion impacts then bring about an increase in current fluctuation and sputtering causes the permanent deformation or changes of the emitter tips. Consequently, great deterioration occurs in the electron emission characteristic and it is difficult to maintain a stable operation for a long time. Accordingly, in order to maintain a stable characteristic and increase the life of the device, a vacuum environment must be controlled by exhausting, to a permissible partial pressure, gas of a kind which damages the emitters.

In this regard, however, there are problems inherent in the conventional method. Specifically, control of residual gas performed during an exhausting process has been based on experience since gas of a kind which damages the emitters or its permissible partial pressure is not explicitly defined. As a result, deterioration with the passage of time has occurred in the electron emission characteristic and, once deteriorated, it has been impossible to restore the electron emission characteristic.

SUMMARY OF THE INVENTION

It is an object of the present invention to provide a device incorporating a field emission type cold cathode and an exhausting method and an exhaust system in the same, which can maintain a good electron emission characteristic stably and for a long time by controlling, to its permissible partial pressure, residual gas of a kind which exists in a vacuum tank and damages emitters.

In order to achieve the foregoing objective, according to the present invention, a field emission type cold cathode incorporated device comprises a field emission type cold cathode which includes a number of electron emitting sections having sharp projections, and a vacuum tank for placing the field emission type cold cathode in a vacuum environment. In the field emission type cold cathode incorporated device thus constructed, a partial pressure of particular noble gas in residual gas contained in the vacuum tank is set equal to or lower than C/I (C is a constant and I is a maximum emission current value per each of a number of electron emitting sections during driving of the field emission type cold cathode). In particular, if specific noble gas is argon, its argon partial pressure is set equal to or lower than $6.9\times10^{-15}/I$ (Torr). If the field emission type cold cathode is driven under such a gas partial pressure, no damage is given to the electron emitting sections. Accordingly, the occurrence of deterioration in an electron emitting characteristic can be prevented and emission currents can be produced stably and for a long time.

Furthermore, according to the present invention, an exhausting method is provided for the device incorporating a field emission type cold cathode. This exhausting method is used to monitor a partial pressure of particular residual gas in a vacuum tank as a constituting element of the field emission type cold cathode incorporated device by, for example, a mass analyzer, and control the same to a partial pressure or lower which gives no damage to electron emitting sections. In particular, if specific residual gas is argon, its argon partial pressure is set equal to or lower than $6.9\times10^{-15}/I$ (Torr). Accordingly, the field emission type cold cathode incorporated device can be provided, which can control the residual gas in the vacuum tank with good reproducibility and maintain a stable operation for a long time.

The above and other objects, features and advantages of the present invention will become apparent from the following description with reference to the accompanying drawings which illustrate examples of the present invention.

DESCRIPTION OF THE REFERRED EMBODIMENT

This section describes the present invention by taking as an example the use of a field emission type cold cathode as the electron gun of a CRT in an isolated vacuum tank.

According to the foregoing "Vacuum, Vol. 38" page 848, a major portion of residual gas in the CRT is Ar (argon) of $2\times10^{-7}$ Torr, and the remaining portion contains He of $1\times10^{-8}$ Torr and CO, $N_2$ and $CH_4$ of $1\times10^{-8}$ Torr or lower. The degree of damage given by residual gas to each emitter as an electron emitting section having a sharp projection is decided by a partial pressure of the residual gas, ionization efficiency in which the residual gas is ionized by emitted electrons and a sputtering rate in which produced ions are beaten out atoms of each emitter surface.

Figure 4:
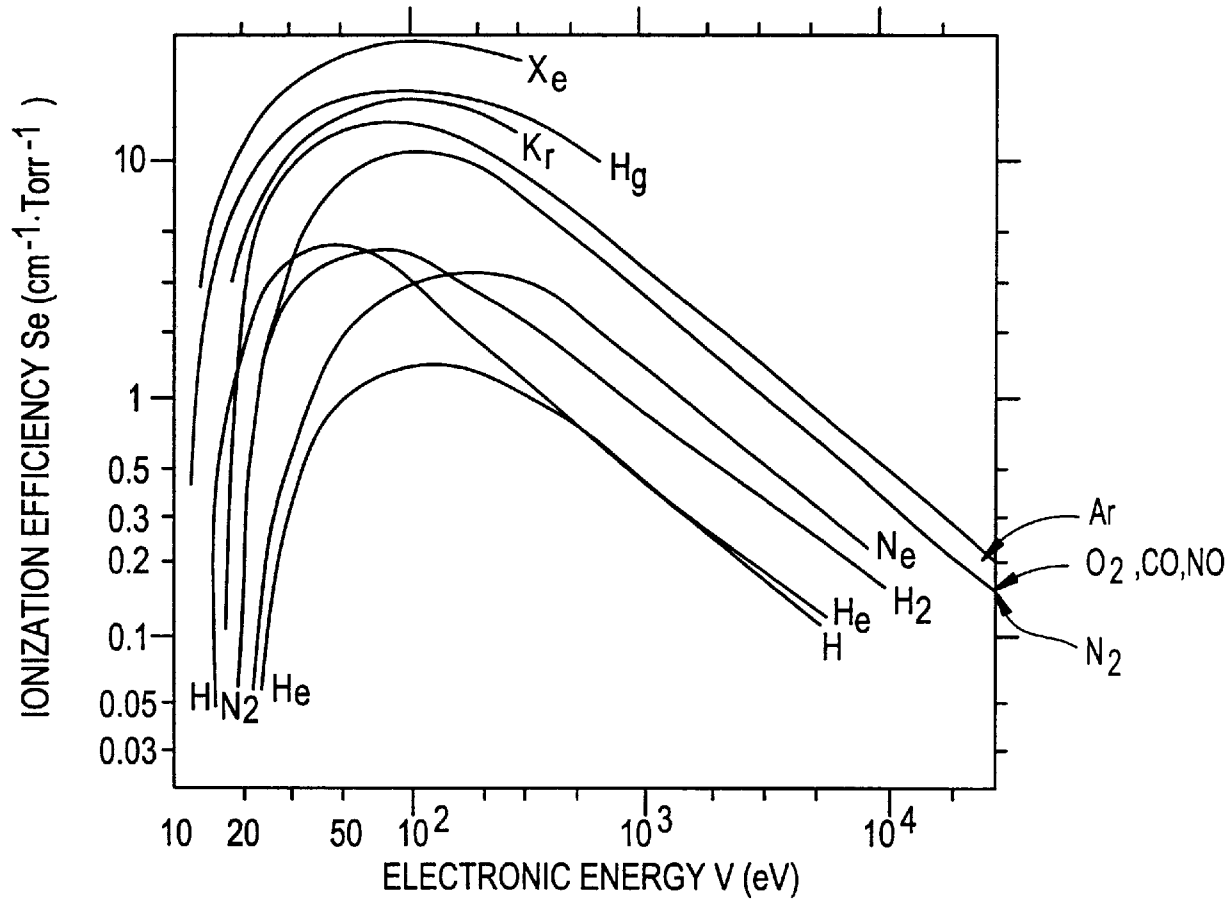
FIG. 4 is a graph showing incident electronic energy dependence of ionization efficiency of each of various gases.

Incident electronic energy dependence of ionization efficiency of each of various gases described in "Ionized Gasses" (Oxford University Press. 1995) by A. von Engel, is shown in FIG. 4. Each of noble gasses Ar, Kr and Xe having large masses has larger ionization efficiency than residual gas such as He, CO, $N_2$ or $CH_4$ existing in the CRT within all the electronic energy ranges. Generally, as a mass is larger, a sputtering rate is larger. Accordingly, if residual gas in the CRT is considered, Ar occupying a major portion of the residual gas has higher partial pressure, higher ionization efficiency and a larger mass compared with other residual gasses and thus the effect of Ar giving damage to the emitters may be larger.

We made an experiment in order to investigate the effect of a partial pressure of Ar given to an electron emission characteristic.

Figure 1:
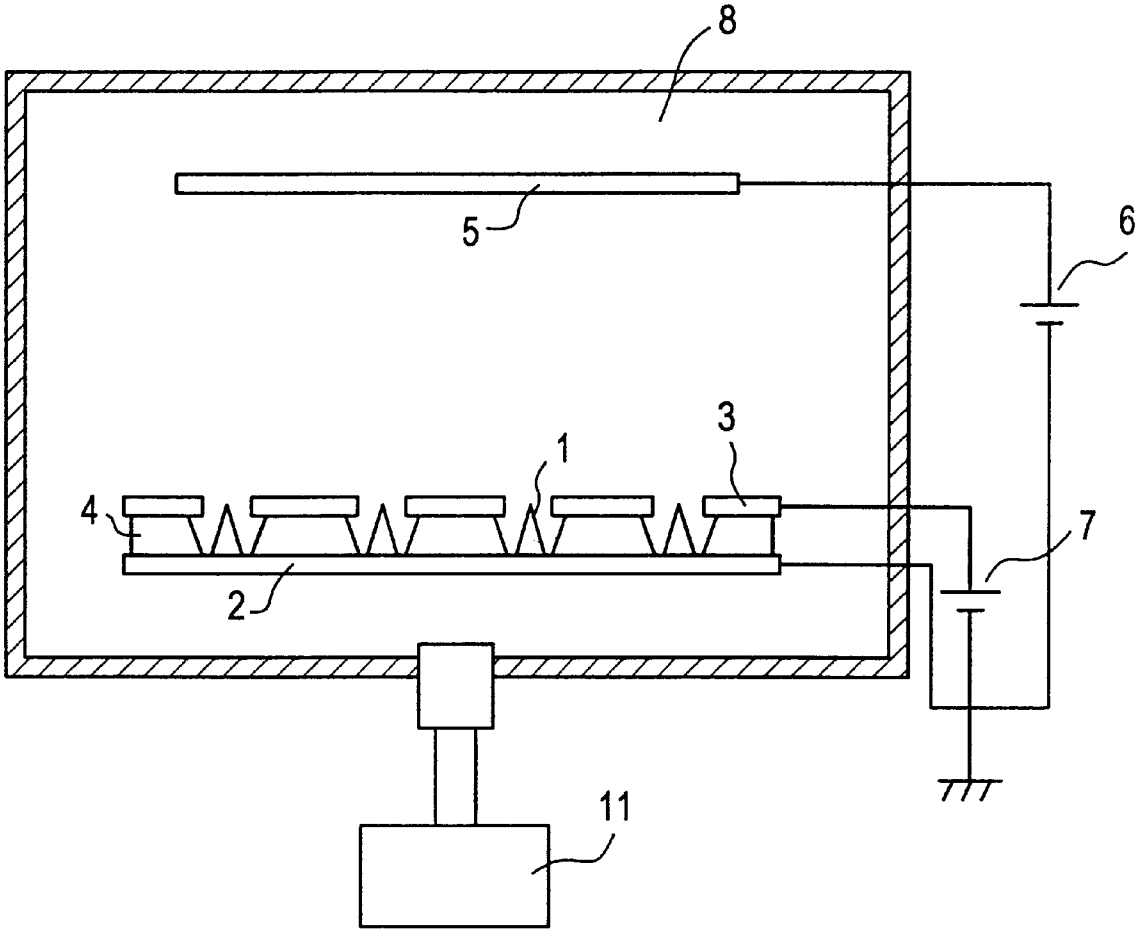
FIG. 1 PRIOR ART
FIG. 1 is a view showing in outline a conventional structure of a field emission type cold cathode and a driving circuit.
Figure 2:
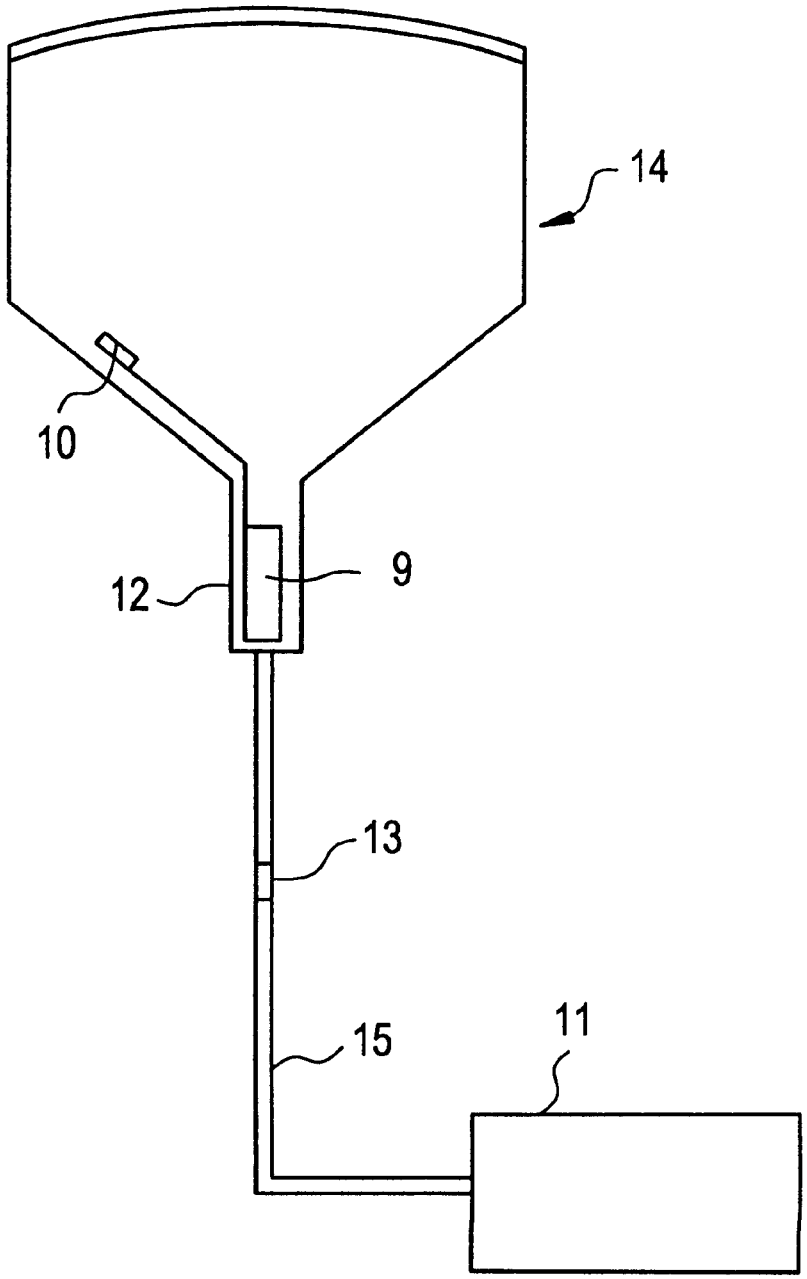
FIG.2 PRIOR ART
FIG. 2 is a view showing in outline an exhaust line of a CRT as a conventional device incorporating a field emission type cold cathode.
Figure 3:
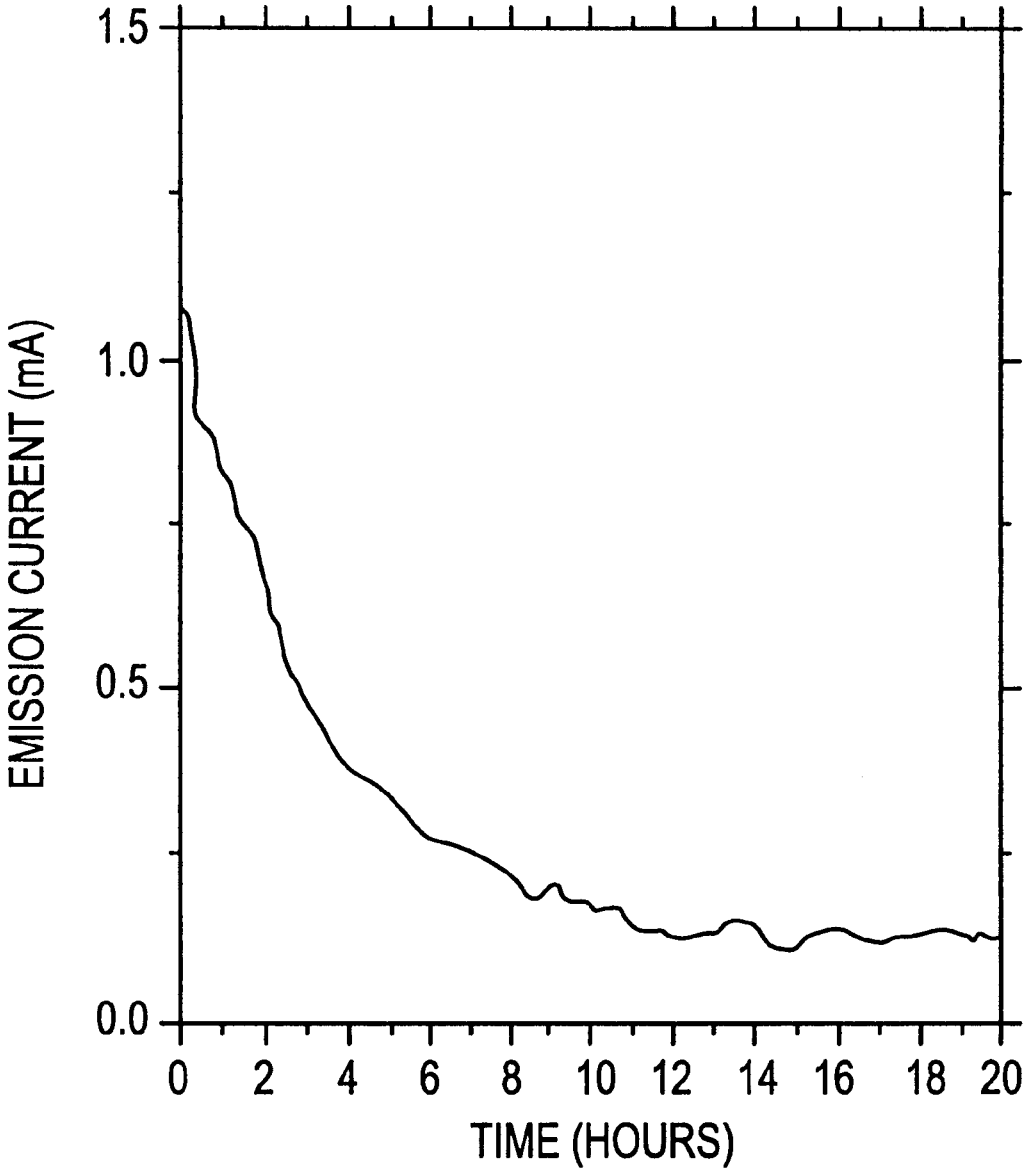
FIG.3 PRIOR ART
FIG. 3 is a view showing a change of an emission current with the passage of time in the CRT as the conventional device incorporating a field emission type cold cathode.
Figure 5:
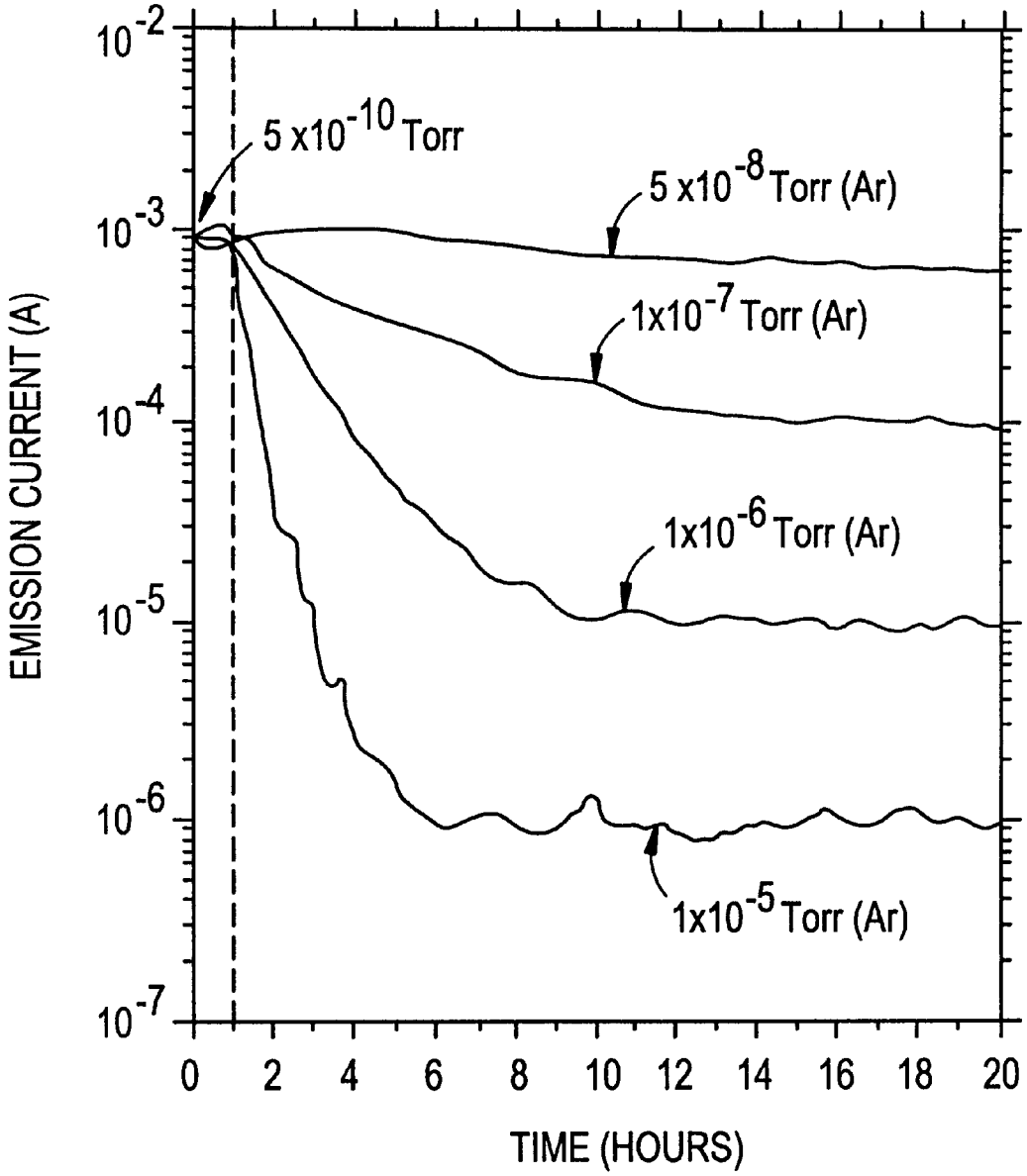
FIG. 5 is a graph showing a change with the passage of time in an emission current when an Ar partial pressure is changed.

This experiment was carried out as follows. We used the field emission type cold cathode and its driving circuit shown in FIG. 1. In the experiment, a substrate 2 shown in FIG. 1 was a silicon substrate highly doped to be an n type, and an insulated layer 4 was composed of a thermal oxidized film ($SiO_2$) of 500 nm. An emitter 1 and a gate layer 3 were molybdenum. The opening diameter of the gate layer 3 surrounding the emitter 1 was 600 nm, and the number of elements amounted to 1300. For a manufacturing method of this field emission type cold cathode, we followed the conventional example described on page 5248 of "Journal of Applied Physics. Vol. 47 (1976)". For a driving method, we set a gate voltage 7 to 90 V and an anode voltage 6 to 500 V. Hereinafter, the flow of electrons entering the anode electrode 6 will referred to as an emission current. We always kept a vacuum tank 8 in an exhausted state by using a turbo-molecular pump so as to maintain a very high vacuum of $5\times10^{-10}$ Torr. As a result, as can be understood from FIG. 5, we found that if Ar was introduced in the vacuum tank, an emission current of about $1\times10^{-3}$ A (ampere) produced in the very high vacuum was reduced with time and saturated after a certain time. Also, we found that as an Ar partial pressure was larger, a reduction rate of an emission current was larger and a current value in a saturation region was smaller.

Figure 6:
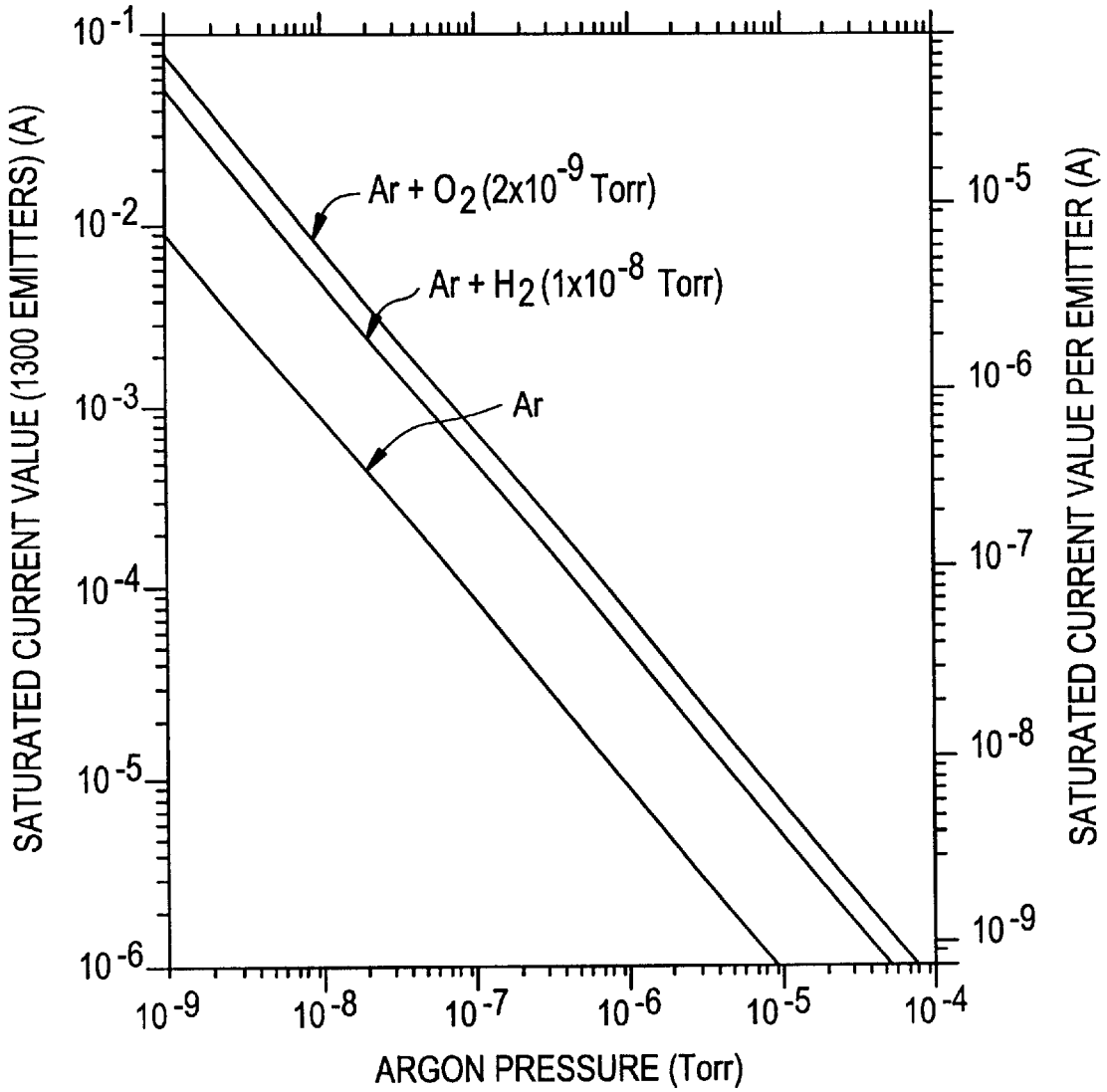
FIG. 6 is a graph showing Ar partial pressure dependence of a saturation current value.

Ar partial pressure dependence of each of saturated current values (current average value in the saturation region) emitted from the emitters amounting to 1300 is shown in FIG. 6 in number in a double logarithmic manner. In FIG. 6 a relationship between a saturated current value and an Ar partial pressure is clearly represented by a straight line having slope of about −1. It can thus be understood that a saturated current value is in inverse proportion to an Ar partial pressure and a product between variables of these two values always becomes a constant (herein, $9.0\times10^{-12}$ Torr·A). Hereinafter, this constant will be represented by C. As to a main cause of such a relationship, the chemically active residual gas other than Ar which adsorbed on the emitter impedes that the emitter is damaged by Ar ion irradiation, and consequently the adsorption and the damaging are placed in steady states. In fact, residual gas contained other than introduced Ar is at about $1\times10^{-9}$ Torr irrespective of an Ar partial pressure. This residual gas mainly contains hydrogen, carbon monoxide and carbon dioxide. The incident number of Ar ions implanted to the emitter per unit time is in proportion to a product between an Ar partial pressure and an emission current. Thus, a steady state between the adsorbing speed of residual gas other than Ar, the residual gas being contained up to a certain quantity irrespective of an Ar partial pressure, and the number of Ar ions for irradiation per unit time, in order to maintain constant a product between an Ar partial pressure and a saturated current, is saturated by a high emission current when an Ar partial pressure is low and by a low emission current when an Ar partial pressure is high. Accordingly, in order to maintain an emission current of about $1\times10^{-3}$A, for example, of the foregoing very high vacuum, in an Ar atmosphere as well, an Ar partial pressure must be controlled to at least $9.0\times10^{-9}$ Torr or lower. An emission current used herein means a total emission current from an array having 1300 emitters. Assuming that Ar ions are uniformly implanted to each emitter, it may be appropriate to convert the foregoing product between the Ar partial pressure and the saturated current into a value per one emitter. Also, the foregoing relationship between the saturated current and the Ar partial pressure can be applied irrespective of the number of emitters. If the foregoing product between the Ar partial pressure and the saturated current value, in other words, a constant C, is converted into a value per one emitter, the value is $6.9\times10^{-15}$ Torr·A from the right axis of the graph of FIG. 6.

By introducing noble gas other than Ar in the vacuum tank, we identified the existence of the foregoing relationship between the argon partial pressure and the saturated current value, in which the product between the values thereof is constant, both in the case of introducing active gas containing hydrogen or oxygen together with Ar and in the case of changing a gate voltage and an anode voltage. In these cases, however, products (constants C) between noble gas partial pressure and saturated current values show values different from each other. For example, in the field emission type cold cathode having 1300 emitters and the driving circuit described above with reference to the experiment, if a certain quantity of oxygen of $2\times10^{-9}$ Torr is introduced in the vacuum tank together with Ar, for Ar partial pressure dependence of a saturated current value, a constant C is $8\times10^{-11}$ Torr·A($6.2\times10^{-14}$ Torr·A per one emitter). Thus, by adding a small quantity of oxygen, a permissible Ar partial pressure which gives no damage to the emitters can be widened to a low vacuum region. We observed the same trend when oxygen of $1\times10^{-8}$ Torr was introduced. If a certain quantity of hydrogen of $1\times10^{-8}$ Torr is introduced in the vacuum tank together with Ar, a constant C is $5\times10^{-11}$ Torr·A ($3.8\times10^{-14}$ Torr·A per one emitter). Thus, the same effect as that in the case of introducing oxygen is obtained. However, if hydrogen of $2\times10^{-9}$ Torr is introduced in the vacuum tank, no improvement of the saturated current like that obtained by oxygen is seen, and the level of the saturated current is the same as that of the saturated current when only Ar is introduced. Accordingly, by introducing a proper quantity of active gas containing oxygen or hydrogen together with Ar, a permissible Ar partial pressure which gives no damage to the emitters can be set larger (constant C is set larger) than that when only Ar is introduced.

A constant C also depends on gate and anode voltages. This dependence arises because of a change in energy made when emitted electrons clash with residual gas or when ionized residual gas ions are implanted to the emitters. Such an energy change affects ionization efficiency or a sputtering rate.

It can thus be understood that, in order to maintain a stable emission current for a long time, a partial pressure of noble gas contained in residual gas in the vacuum tank must be controlled to be C/I or lower. C is a constant dependent on the kind of noble gas, the kind of contained gas other than noble gas and its partial pressure, a control voltage or the like. I is a maximum emission current value per one emitter during driving of the field emission type cold cathode.

If the field emission type cold cathode as an electron gun is mounted in a device such as a CRT or the flat panel display, constant exhaustion of the vacuum tank included in the device by a vacuum pump having a large exhaust speed may lead to increases in costs, size and weight for the device. Accordingly, the vacuum tank is typically placed independent of an exhaust line by performing the process of completely detaching the device from the exhaust line after vacuum exhaustion.

Figure 7:
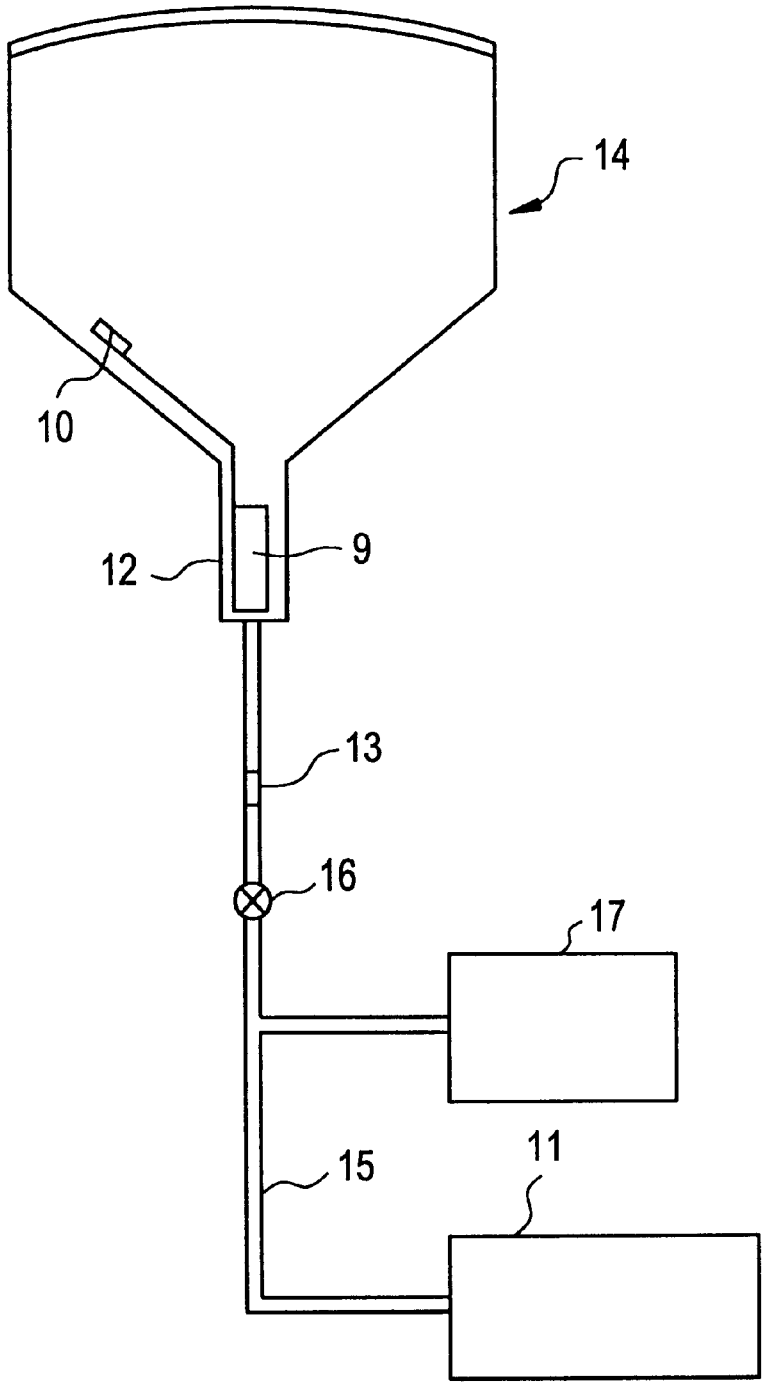
FIG. 7 is a view showing in outline an exhaust line of CRT as a device of the present invention which incorporated a field emission type cold cathode.

Referring to FIG. 7, a CRT 14 includes an electron gun 9 as a field emission type cold cathode, a getter 10 mainly made of barium, a screen, and so on, in a vacuum tank. An exhaust line 15 is connected to the piping of the neck section 12 of the CRT 14 by a connecting section 13. The field emission type cold cathode used herein includes 1300 emitters as in the case of the foregoing type. From the connecting section 13 to a downstream side, the exhaust line 15 includes a valve 16, a mass analyzer 17 and a vacuum pump 11 in sequence. Preferably, the mass analyzer 17 should be placed very close to the electron gun 9. If the mass analyzer 17 is placed in the neck section 12 of the CRT 14, a port must be newly provided for connecting the mass analyzer to the neck section 12 of each CRT 14, and the number of work steps may be increased. Thus, herein, the mass analyzer 17 is attached to the exhaust line 15.

Next, the method of exhausting a CRT as one example of a field emission type cold cathode by using the foregoing device elements will be described by referring to FIGS. 7 to 9.

Figure 8:
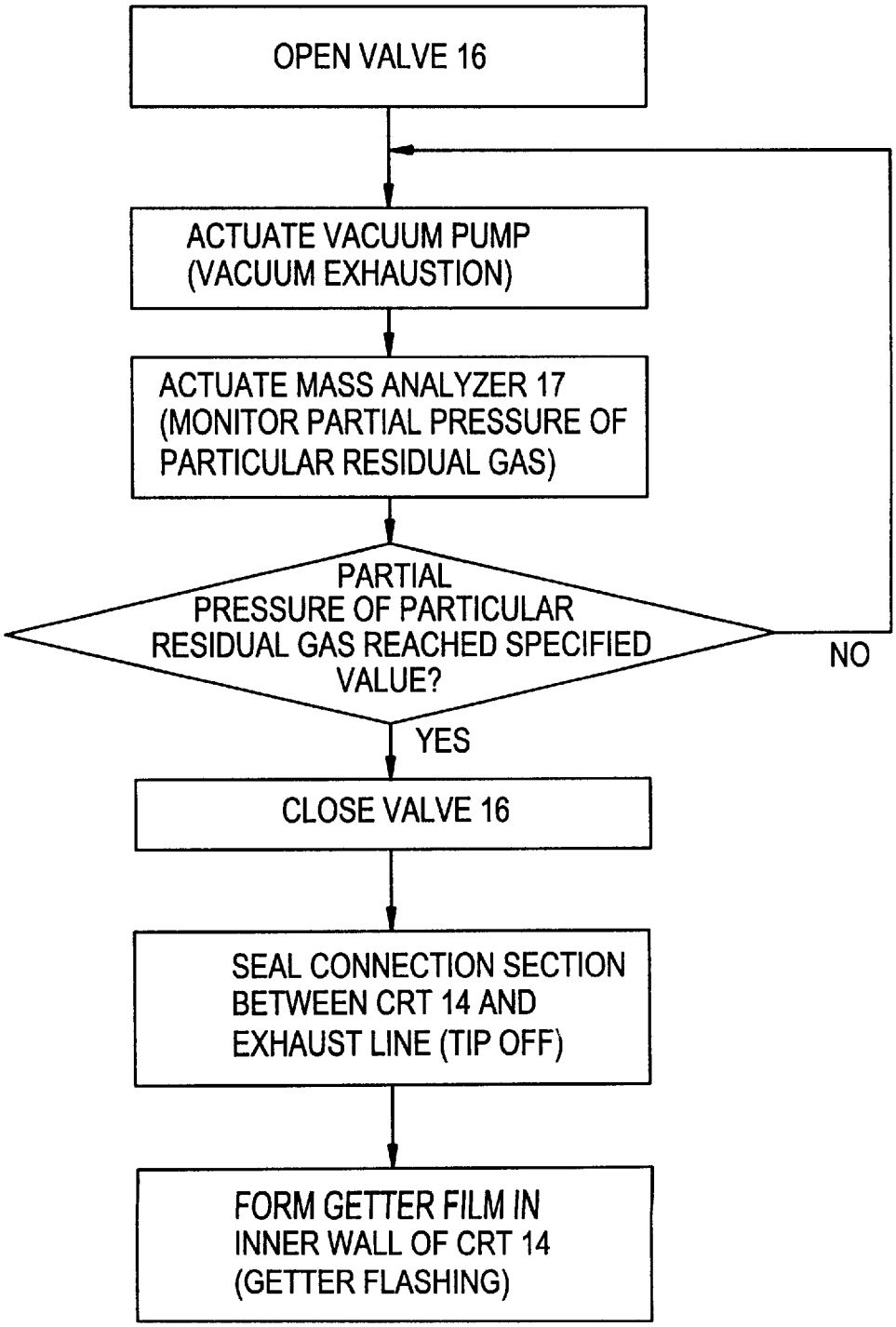
FIG. 8 is a flow diagram showing a process of a manufacturing method of the CRT by using the exhausting system shown in FIG. 7.
Figure 9:
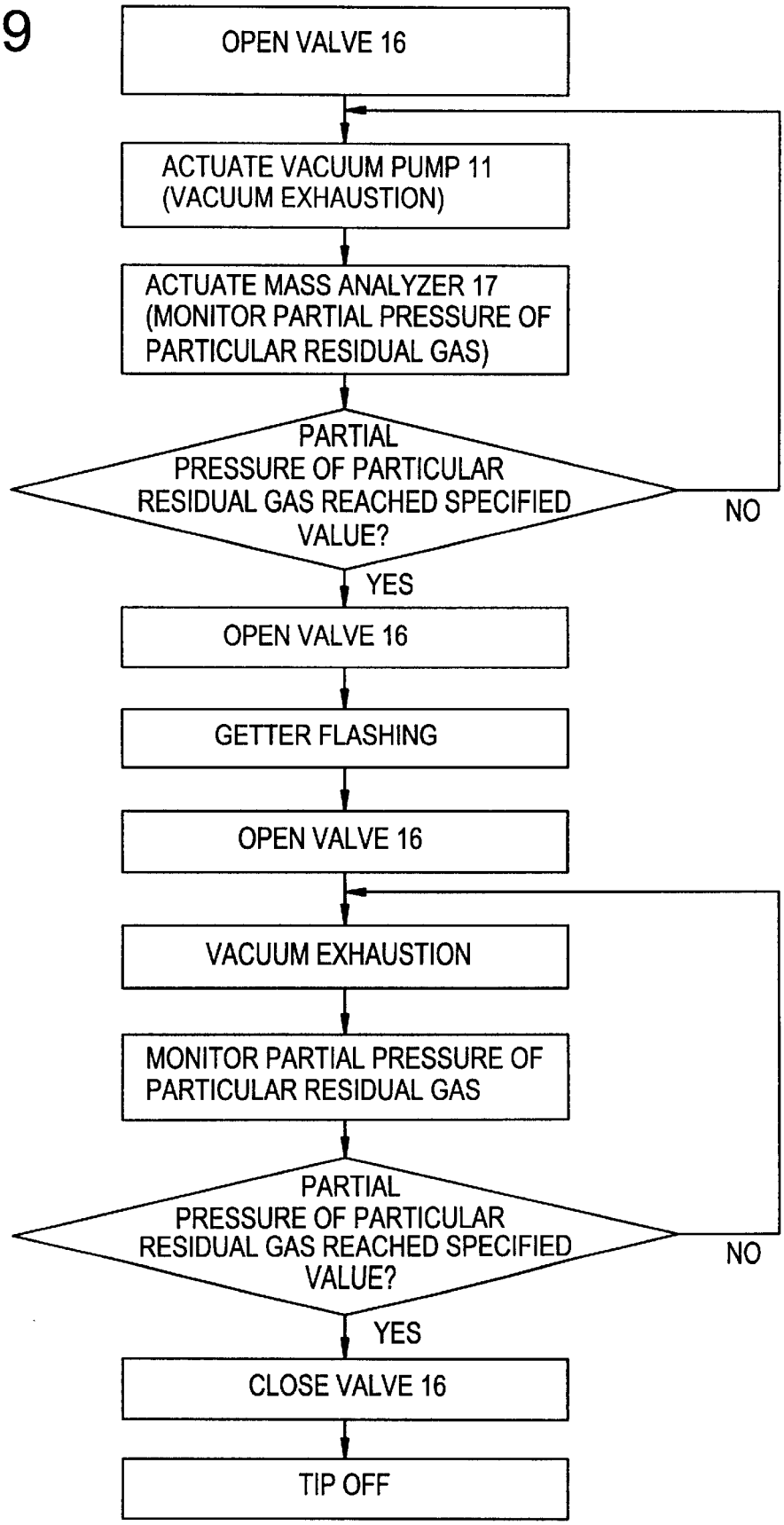
FIG. 9 is a flow diagram showing a preferable example of the manufacturing method shown in FIG. 8.

According to this exhausting method, the piping of the neck section 12 of the CRT 14 constituting the vacuum tank is connected to the exhaust line 15, the valve 16 is then opened as shown in FIG. 8 and vacuum exhaustion is performed while operating the mass analyzer 17.

After the exhaustion under a room temperature has reached $10^{-4}$ Torr or lower, the CRT 14 is heated up to 400° C. by an external heater while continuing exhaustion so as to promote degassing. After the exhaustion has been performed until an Ar partial pressure detected by the mass analyzer 17 reaches a desired partial pressure value, the connecting section 13 between the neck section 12 of the CRT 14 and the exhaust line 15 is cut off and then a tip of the neck section 12 is sealed (tipped off) while the CRT 14 is slowly cooled. An exhaust time is decided based on a permissible Ar partial pressure decided by a maximum emission current per one emitter during driving of the field emission type cold cathode, the size of the CRT, the performance of an exhaust system, and so on. In our case, based on the foregoing relationship between the Ar partial pressure and the saturated current value, we set a permissible Ar partial pressure to $9\times10^{-9}$ Torr (if a maximum emission current from 1300 emitters was $1\times10^{-3}$ A) and the size of the CRT 14 to 15 inches, and used an oil diffusion pump for the vacuum pump 11. The exhaust time in a temperature of 400° C. was about 1.5 hours.

After tipping off, when a getter 10 in the CRT 14 is subjected to high frequency induction heating from the outside, an active getter film is formed (getter flushing) in the inner wall of the CRT 14. In this way, active gas remaining in the CRT 14 is adsorbed by the getter film and thereby a vacuum degree can be further increased.

In this process, however, Ar or He of noble gas weakly coupled to the getter 10 itself displace an active residual gas in the CRT 14, and the noble gas may be conversely emitted in the CRT 14. Consequently, last Ar partial pressure control in the CRT 14 may become difficult. In such a case, as shown in FIG. 9, preferably, an operation should be performed as follows. After vacuum exhaustion is performed until an Ar partial pressure reaches a permissible partial pressure value, the valve 16 is closed and getter flushing is performed. Then, the valve 16 is opened and, after vacuum exhaustion is performed until an Ar partial pressure reaches a permissible partial pressure value, the valve 16 is closed again and then tipping off is performed. Alternatively, a getter containing a small quantity of Ar may be used from the beginning.

Figure 10:
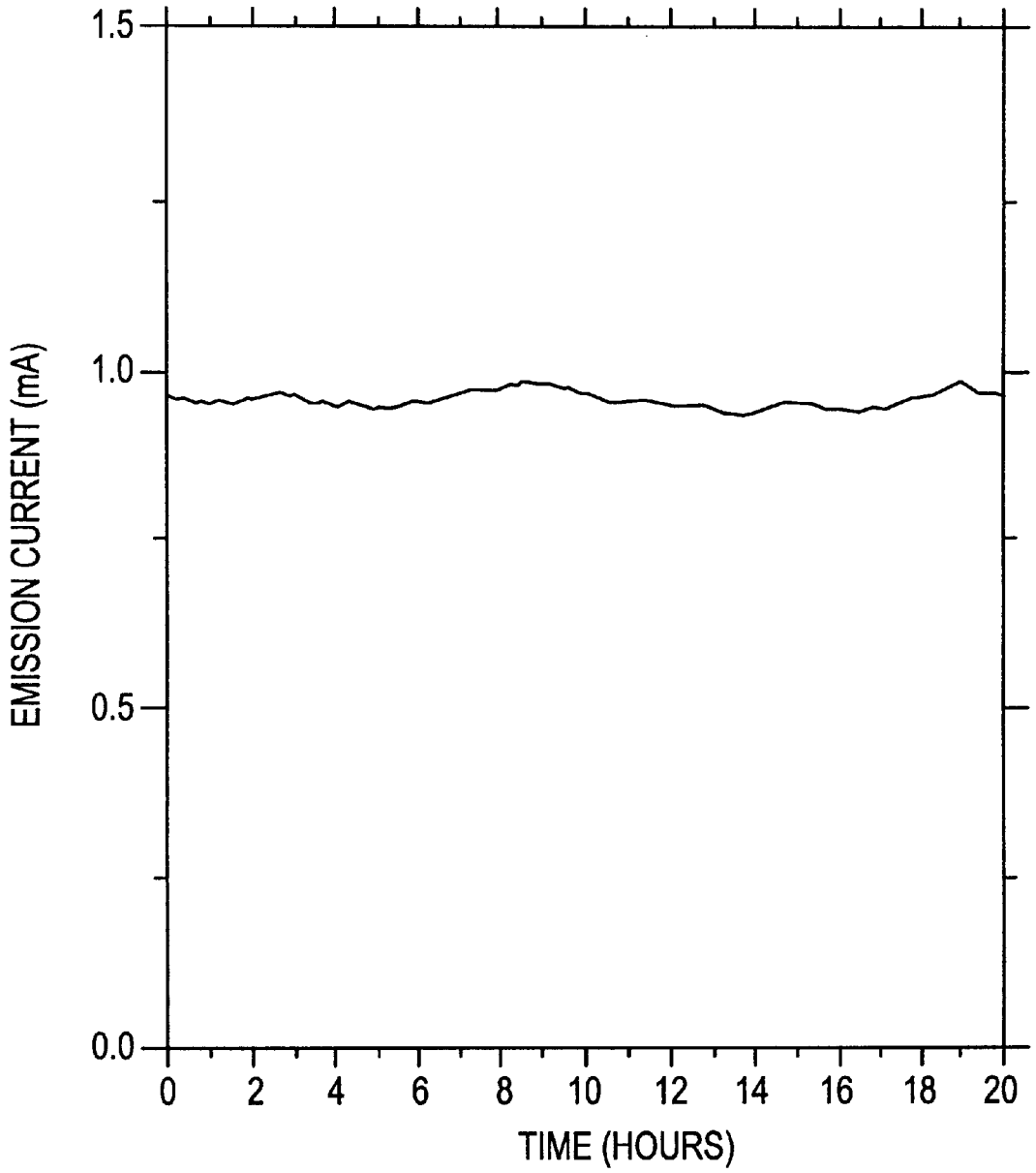
FIG. 10 is a graph showing a change with the passage of time in an emission current of the CRT as a device of the present invention which incorporated the field emission type cold cathode.

Referring to FIG. 10 which is a graph, there is shown a time-depending change of the emission current of a CRT manufactured according to the foregoing exhaust process. A field emission type cold cathode used herein has specifications identical to those for the foregoing cold cathode. In our case, a last Ar partial pressure in the CRT was $8\times10^{-9}$ Torr. As can be understood from FIG. 10, by controlling a vacuum environment in the CRT to an Ar partial pressure ($9\times10^{-9}$ Torr) permitted at the time of generation of an emission current 1 mA from 1300 emitters or lower, no deterioration occurs in the emission current because of emitter damage after the passage of time, which is different from the conventional example. Accordingly, a stable characteristic can be maintained.

The exhausting method for the vacuum tank of the CRT has been described. It must be understood, however, that a similar exhausting method can be basically applied for a flat panel display as referred to in Published Japanese Patent Application No. 7-29520 (1995). Specifically, a panel is vacuum-exhausted, a pipe is completely sealed and, by getter flushing, a substantial vacuum degree is maintained. Accordingly, also in the flat panel display, a permissible noble gas partial pressure can be controlled by using the same exhaust line as that of FIG. 7, and thus as in the case of the CRT, a stable emission current can be maintained for a long time.

While a preferred embodiment of the present invention has been described using specific terms, such description is for illustrative purposes only, and it is to be understood that changes and variations may be made without departing from the spirit or scope of the following claims.

What is claimed is:

1. A device comprising:

a field emission type cold cathode including a number of electron emitting sections, said sections having sharp projections; and a vacuum tank for placing said field emission type cold cathode in a vacuum environment, wherein a partial pressure of a particular noble gas in a residual gas contained in said vacuum tank is set equal to or less than C/I, where C is a predetermined constant and I is a maximum emission current value per one of said number of electron emitting sections during driving of said field emission type cold cathode.

2. A device according to claim 1, wherein said noble gas in said residual gas is argon and a partial pressure of said argon is set equal to or less than $6.9\times10^{-15}$/I (Torr).

3. An exhausting method for a vacuum tank in a field emission type cold cathode incorporated device including a field emission type cold cathode having a number of electron emitting sections, for placing said field emission type cold cathode in a vacuum environment, said exhausting method comprising:

exhausting said vacuum tank while monitoring a partial pressure of at least one gas in a residual gas in said vacuum tank;

sealing said vacuum tank when a partial pressure of said at least one gas in said vacuum tank is equal to or less than C/I, where C is a predetermined constant and I is a maximum emission current value per one of said number of electron emitting sections during driving of said field emission type cold cathode; and forming a getter film in an inner wall of said vacuum tank.

4. An exhausting method according to claim 3, wherein said at least one gas is argon and said vacuum tank sealing step is performed when a partial pressure of said argon is equal to or less than $6.9\times10^{-15}$/I (Torr).

5. An exhaust method according to claim 3, wherein said at least one gas is a noble gas.

6. An exhausting method for a vacuum tank in a field emission type cold cathode incorporated device including a field emission type cold cathode having a number of electron emitting sections, for placing said field emission type cold cathode in a vacuum environment, said exhausting method comprising:

exhausting said vacuum tank while monitoring a partial pressure of at least one gas in a residual gas in said vacuum tank;

temporarily stopping exhaustion of said vacuum tank when a partial pressure of said at least one gas in said vacuum tank is equal to or less than C/I, where C is a predetermined constant and I is a maximum emission current value per one of said number of electron emitting sections during driving of said field emission type cold cathode;

forming a getter film in an inner wall of said vacuum tank;

resuming said exhaustion of said vacuum tank and monitoring said partial pressure of said at least one gas in said vacuum tank; and sealing said vacuum tank when a partial pressure of said at least one gas in said vacuum tank is equal to or less than C/I.

7. An exhausting method according to claim 6, wherein said at least one gas is argon and said temporary exhaustion stopping step and said vacuum tank sealing step are performed when a partial pressure of said argon is equal to or less than $6.9\times10^{-15}$/I (Torr).

8. An exhaust system according to claim 6, wherein said at least one gas is a noble gas.

9. An exhaust system for a vacuum tank in a field emission type cold cathode incorporated device for placing said field emission type cold cathode in a vacuum environment, said exhaust system comprising:

a vacuum pump;

an exhaust line connected to said vacuum tank and said vacuum pump;

a mass analyzer provided in said exhaust line for monitoring a partial pressure of at least one gas in a residual gas in said vacuum tank; and a valve disposed between said mass analyzer in said exhaust line and said vacuum tank.

10. An exhaust system according to claim 9, wherein said at least one gas is a noble gas.

* * * * *